United States Patent [19]

Speraw

[11] Patent Number: 4,680,425

[45] Date of Patent: Jul. 14, 1987

[54] CABLE STRAIN RELIEF DEVICE

[75] Inventor: Floyd G. Speraw, Lexington, S.C.

[73] Assignee: NCR Corporation, Dayton, Ohio

[21] Appl. No.: 746,895

[22] Filed: Jun. 19, 1985

[51] Int. Cl.[4] ..... H01R 13/585

[52] U.S. Cl. ..... 174/50; 174/135; 312/223; 361/390

[58] Field of Search ..... 174/50, 135; 339/103 R, 339/105, 106; 312/223; 361/334, 390, 428; 16/114 R

[56] References Cited

U.S. PATENT DOCUMENTS

| | | | |
|---|---|---|---|
| 988,896 | 4/1911 | Quinn | 16/114 R |
| 1,877,514 | 9/1932 | Katzman | 312/223 X |
| 3,951,504 | 4/1976 | Clark | 339/103 R |

FOREIGN PATENT DOCUMENTS

| | | | |
|---|---|---|---|
| 1206679 | 9/1970 | United Kingdom | 361/390 |

*Primary Examiner*—Arthur T. Grimley
*Assistant Examiner*—D. A. Tone
*Attorney, Agent, or Firm*—Wilbert Hawk, Jr.; Edward Dugas

[57] ABSTRACT

In accordance with the present invention, there is provided a rigid U-shaped bracket having its end portions projecting along a pivot axis which is substantially parallel to the bottom of the U-shape. Brackets are provided for pivotally mounting the U-shaped bracket to a cabinet in a position proximate the cables and the electronic equipment served by the cables, such that the cables are positionable between the U-shaped bracket and a portion of the cabinet with substantially a 90° bend. A pull on any, or all, of the cables positioned under the U-shaped bracket will cause the bracket to rotate around the pivot axis, toward the cabinet, creating a clamping action on the cable. The clamping action prevents the transmission of the pull to connectors connecting the cables to the equipment within the cabinet. In the absence of a pull on a cable, all of the cables are restrained in a secure position by the U-shaped bracket to prevent interference with other portions of the electronic cabinet such as a door, the continued opening and closing of which could chafe the cables, damaging the cables and/or the door.

6 Claims, 3 Drawing Figures

CABLE STRAIN RELIEF DEVICE

BACKGROUND OF THE INVENTION

This invention relates to a device for preventing pulls on cables from being transmitted to associated connectors and for preventing the interference of the cables with other proximate structures such as cabinet doors.

The invention is particularly adapted for use with cabinet mounted electronic equipment wherein there is positioned a multiplicity of circuit boards which are connected to a plurality of input/output cables by means of electrical connectors. At the point of egress from the cabinet, damage may occur to the cabinet or to the cables when the cables are inadvertently pulled if the cables are not secured. In general the number of cables entering a cabinet is dependent on the particular configuration of the electronics mounted therein. The diameter of the cables may also vary, from cable to cable, as a function of the number and size of conductors per cable. An efficient strain relief device should therefore be able to restrain a variable number of cables having different diameters. In select applications it is also necessary to permit the removal of the circuit boards, or other electronic subsystem to which the connectors are affixed, with the connectors and cables remaining attached. Therefore, the strain relief device should also be able to release one or all of the cables without the need for disconnecting any connector.

The present invention derives its ability to accomplish the above desired results with a simple and efficiently configured device.

SUMMARY OF THE INVENTION

In accordance with the present invention, there is provided a rigid U-shaped bracket having its end portions projecting along a pivot axis which is substantially parallel to the bottom of the U-shape. Means are provided for pivotally mounting the bracket to a cabinet in a position proximate the cables and the electronic equipment serviced by the cables, such that the cables are positionable between the U-shaped member and a portion of the cabinet with substantially a 90° bend. A pull on any cable positioned under the U-shaped member will cause the member to rotate around the pivot axis, toward the cabinet, creating a clamping action on the cable. The clamping action prevents the transmission of the pull to connectors connecting the cable to the equipment within the cabinet. In the absence of a pull, all of the cables are restrained in a secure position by the bracket to prevent interference with other portions of the electronic cabinet.

From the foregoing, it can be seen that it is a primary object of the present invention to provide a device for preventing the transfer of stress to cable-connected electrical connectors.

It is a further object of the present invention to provide an efficient and inexpensive device for protecting cables of differing size from physical damage.

It is another object of the present invention to provide a device which will quickly permit the release of all cables without requiring that the cables be disconnected from their associated electronic device.

These and other objects of the present invention will become more apparent and better understood when taken in conjunction with the following description and the accompanying drawings, throughout which like characters indicate like parts and which drawings form a part of the present disclosure.

DETAILED DESCRIPTION OF THE PREFERRED EMBODIMENT OF THE INVENTION

Figure 1:
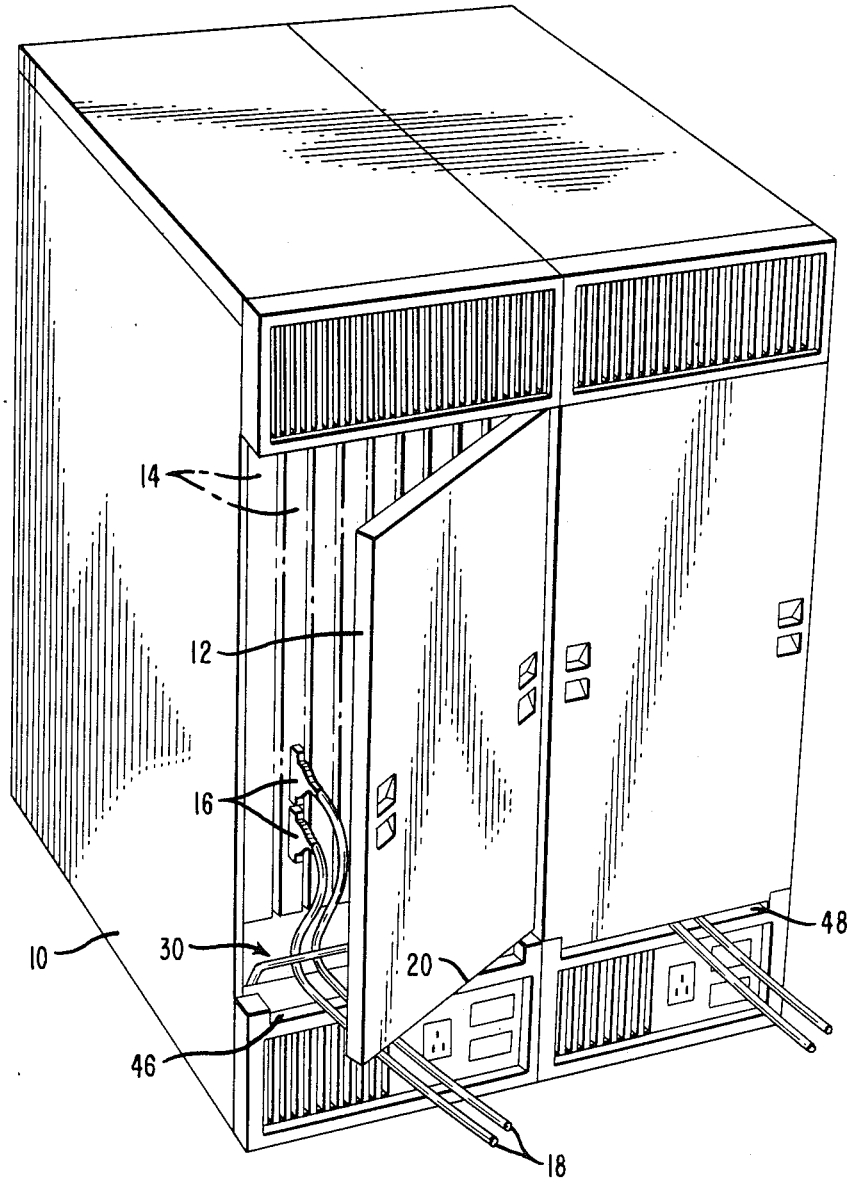
FIG. 1 is a perspective view illustrating the preferred device in operating position within an electrical equipment cabinet.

Referring to FIG. 1, the cable strain release device 30 is mounted within a cabinet 10. The cabinet 10 holds a number of electronic devices 14, which may be circuit boards, having electrical connectors 16 connected to one end. Each of the connectors 16 is in turn connected to at least one cable 18. The cables 18 are input/output cables which carry signals to and from the electronic devices 14 and which are routed through the device 30 and egress from the cabinet 10 through a defined space 48. The space 48 is defined by the bottom 20 of a cabinet door 12, and the top of a bottom rear cover 46. The cables 18 must be kept clear of the door 12 at all times to prevent chafing of the cables and possible damage to the door.

Figure 2:
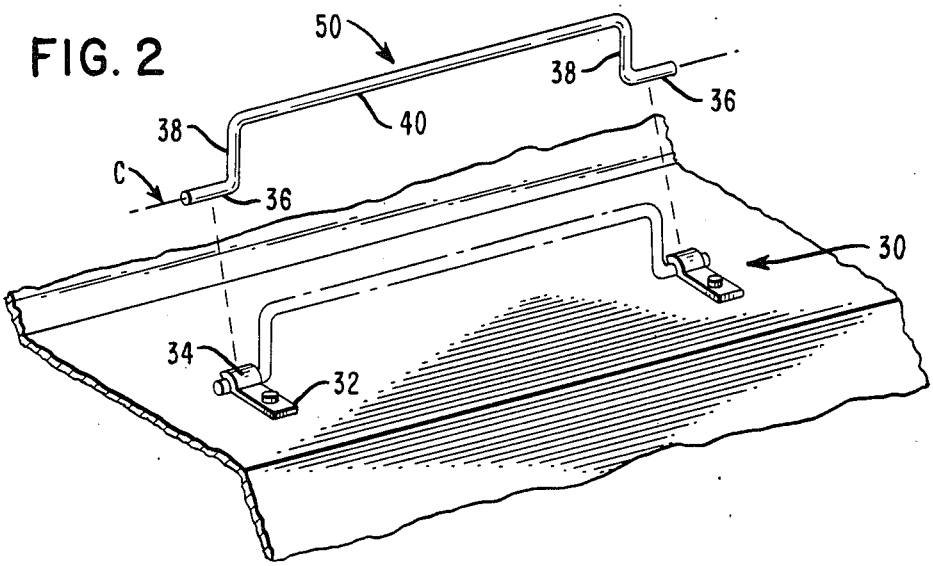
FIG. 2 illustrates the preferred configuration of the device.

Referring to FIG. 2, the moving part of device 30 is a U-shaped bracket 50 having a base (top) portion 40, with two arm portions 38 extending 90° from the base portion and two end portions 36 extending 90° from the arm portions 38 along an axis which is substantially parallel to the base portion 40. The labeled axis C is the pivot axis about which the U-shaped bracket 50 will rotate. The bracket 50 is held along the axis C by a pair of brackets 32, each having a tab section 34 which engages an associated end portion 36 of the bracket 50. The dotted outline of bracket 50 shows its operating position in engagement with the brackets 32. The bracket 50 may be formed from a steel rod, giving it a circular cross-section.

Figure 3:
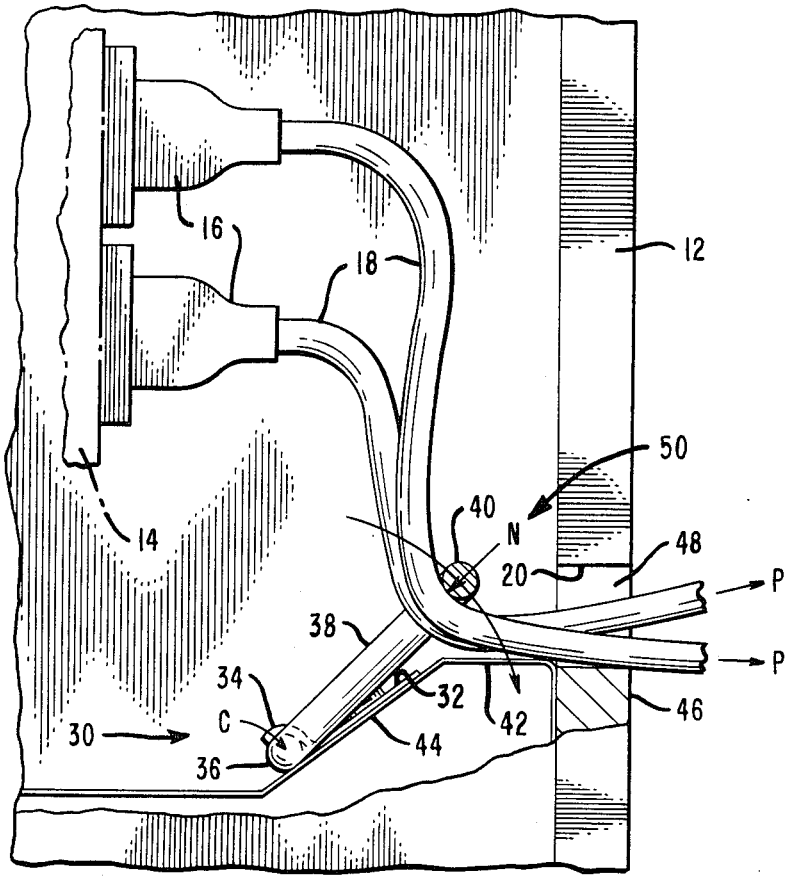
FIG. 3 illustrates, partially in sectional view, the preferred device in its operating position for clamping cables in a secure position.

Referring now to FIG. 3, the U-shaped bracket 50 is pivotally mounted to a sloping inner wall 44 of the cabinet 10 by the pair of brackets 32. The tab section 34 of each bracket 32 engages the associated end portion 36 of the U-shaped bracket 50 to form a bearing surface for pivoting bracket 50 about the axis C. The tab sections 34 extend less than half-way around the end portions 36 to facilitate removal of the bracket 50. The cables 18 are held in a non-interferring position by bearing against the base portion 40 of bracket 50. The force exerted by the cables maintains the end portions 36 in contact with the tab sections 34. As can be seen from the FIG. 3 drawing, if the U-shaped bracket 50 were not in place, the cables would chafe against the bottom 20 of door 12. With the bracket in place the cables are held in proximity to the surface 42 and the cabinet rear cover 46. The cable portion on one side of the bracket 50 is substantially perpendicular to the cable portion on the other side of the bracket. In operation, when a pulling force P is applied to a cable along the arrowed direction lines shown, the cable wants to pull out of the cabinet. In so doing, the cable, through friction, causes the bracket 50 to rotate in a clockwise direction, about the pivot axis C, further clamping the cables to the surfaces of members 42 and 46, thereby effectively isolating the force P from the connectors 16.

In order to remove a board 14 without disconnecting the connectors 16, the U-bracket 50 is pressed inward, along the action line labeled N, and the end portions 36 are cleared from engagement with the tab sections 34, one end at a time, and the bracket 50 is removed. The board and cables may then be removed from the cabinet. To re-insert the boards, the procedure is reversed.

As can be seen from the drawings, a plurality of cables of different diameters may be accommodated by the present invention.

While there has been shown what is considered to be the preferred embodiment of the invention, it will be manifest that many changes and modifications may be made therein without departing from the essential spirit of the invention. It is intended, therefore, in the annexed claims, to cover all such changes and modifications as fall within the true scope of the invention.

What is claimed is:

1. A cable strain relief device for protecting cables and their associated connectors from strains and other physical damage comprising:

a cabinet having at least one surface;

at least one cable having an associated connector connected to said cabinet;

a rigid U-shaped bracket for engaging and constraining the cable and having end portions projecting parallel to the bottom of the U-shape; and rigid means engaging said end portions, to permit said U-shaped bracket to pivot about said end portions, said means affixed to the at least one surface of said cabinet in a position proximate said at least one cable and its associated connector such that said U-shaped bracket fits over and constrains said at least one cable with a substantially 90° bend so that a pull force on said at least one cable will cause said at least one cable to engage and rotate said U-shaped bracket in a direction toward said at least one surface of said cabinet thereby squeezing said at least one cable between said U-shaped bracket and said at least one surface of said cabinet so as to prevent the transmission of the pull force to said associated connector.

2. A cable strain relief device according to claim 1 wherein said rigid means adapted to engage said end portions is a pair of brackets each having a tab section which forms a bearing surface for engaging a surface of an associated end portion of said U-shaped bracket.

3. A cable strain relief device according to claim 2 wherein the tab section of each of said pair of brackets forms a bearing surface extending around said end portion less than halfway so as to permit the removal of said end portions from engagement with the bearing surface of said tab section.

4. A cable strain relief device for protecting cables and their associated connectors from strain and other physical damage comprising:

a cabinet having at least one inclined surface;

at least one cable having an associated connector connected to said cabinet proximate said one inclined surface;

a rigid bracket having an open center for receiving said at least one cable and a pair of end portions projecting from said bracket to form pivot points about which the bracket will rotate; and rigid means engaging said end portions, to permit said rigid bracket to pivot about said end portions, said rigid means affixed to said at least one inclined surface in a position proximate the cables and their associated connector such that the part of said at least one cable on one side of the rigid bracket is substantially perpendicular to the part of said at least one cable on the opposite side of said rigid bracket so that a pull force on said at least one cable will rotate said rigid bracket in a direction toward said at least one inclined surface of said cabinet further constraining said at least one cable so as to prevent the transmission of the pull force to an associated connector.

5. A cable strain relief device according to claim 4 wherein said means adapted to engage said end portions is a pair of brackets each having a tab section which forms a bearing surface for engaging a surface of an associated end portion of said bracket.

6. A cable strain relief device according to claim 5 wherein the tab section of each of said pair of brackets forms a bearing surface extending around said end portions less than halfway so as to permit the removal of said end portions from engagement with the bearing surface of said tab section.

* * * * *